US006918154B2

(12) United States Patent
Ben-Ari

(10) Patent No.: US 6,918,154 B2
(45) Date of Patent: Jul. 19, 2005

(54) TOOTHBRUSH WITH LONGITUDINAL AND LATERAL MOTION CONVERSION

(76) Inventor: Tsafrir Ben-Ari, PO Box 327, Shimshit 17906 (IL)

( * ) Notice: Subject to any disclaimer, the term of this patent is extended or adjusted under 35 U.S.C. 154(b) by 435 days.

(21) Appl. No.: 10/230,206

(22) Filed: Aug. 29, 2002

(65) Prior Publication Data

US 2002/0192621 A1 Dec. 19, 2002

Related U.S. Application Data

(63) Continuation-in-part of application No. 09/618,465, filed on Jul. 18, 2000, now Pat. No. 6,477,729.

(51) Int. Cl.[7] ..... A46B 7/10
(52) U.S. Cl. ..... 15/27; 15/167.1
(58) Field of Search ..... 15/22.1, 23, 25–27, 15/167.1; D4/109

(56) References Cited

U.S. PATENT DOCUMENTS

| | | | | | |
|---|---|---|---|---|---|
| 1,091,090 | A | * | 3/1914 | Tacail | 601/141 |
| 1,254,532 | A | * | 1/1918 | Paul | 15/27 |
| 1,503,050 | A | * | 7/1924 | Jurk et al. | 15/23 |
| 2,175,975 | A | * | 10/1939 | Steiner | 15/22.1 |
| 2,691,182 | A | * | 10/1954 | Baize | 15/27 |
| 3,127,627 | A | * | 4/1964 | Yoshiyuki | 15/27 |
| 4,317,463 | A | | 3/1982 | Massetti | |
| 4,438,601 | A | * | 3/1984 | Olson | 451/444 |
| D330,287 | S | * | 10/1992 | Wise | D4/109 |
| 6,389,634 | B1 | * | 5/2002 | Devlin et al. | 15/110 |

FOREIGN PATENT DOCUMENTS

| | | | |
|---|---|---|---|
| DE | 63528 | * | 7/1982 |
| FR | 1147667 | | 11/1957 |
| SU | 1708282 | * | 1/1992 |
| WO | 84/02833 | * | 8/1984 |
| WO | WO99/66815 | | 12/1999 |

* cited by examiner

*Primary Examiner*—Mark Spisich
(74) *Attorney, Agent, or Firm*—Mark M. Friedman

(57) ABSTRACT

A toothbrush has a number of rotatable brush assemblies mechanically linked so as to move together with a handle. Each rotatable brush assembly includes a wheel, with radially projecting bristles, configured to rotate about an axis which is roughly parallel to a plane of contact with the teeth. The axis of rotation is inclined relative to a primary direction of insertion of the toothbrush, corresponding to an extensional direction of the handle, by an angle of between about 15° and about 75°, and preferably closer to 45°.

9 Claims, 16 Drawing Sheets

FIG. 16A
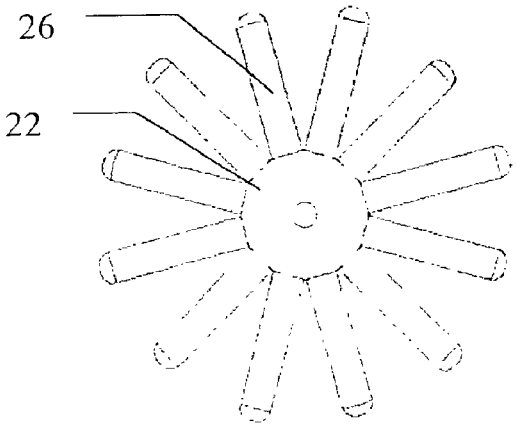
FIG. 16B
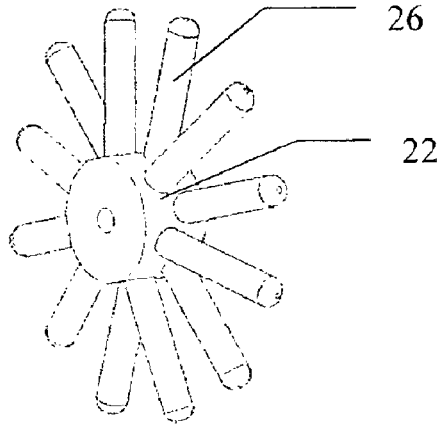
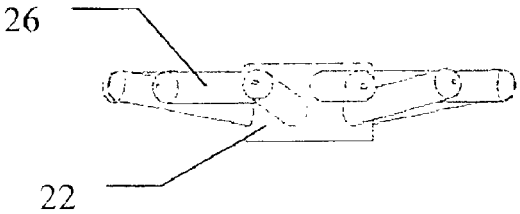
FIG. 16C

TOOTHBRUSH WITH LONGITUDINAL AND LATERAL MOTION CONVERSION

This application is a Continuation-in-Part of pending U.S. patent application Ser. No. 09/618,465 filed Jul. 18, 2000 U.S. Pat. No. 6,477,729.

FIELD AND BACKGROUND OF THE INVENTION

The present invention relates to toothbrushes and, in particular, it concerns a toothbrush with longitudinal to lateral motion conversion.

It is known that best results are achieved by brushing teeth with an upwards and downwards action, thereby helping to remove food material stuck in the cracks between adjacent teeth. In practice, however, only a small proportion of users actually take the trouble to perform such a brushing action. Instead, most users revert to the much easier, but less effective, side-to-side brushing action.

In power-driven toothbrushes, this problem is commonly addressed by causing vibration or rotation of brush elements perpendicular to the handle (which is generally parallel to the side-to-side primary direction of motion). Examples of power-driven toothbrushes which employ such an action may be found in U.S. Pat. No. 2,583,886 to Schlegel, U.S. Pat. No. 2,665,675 to Grover, and U.S. Pat. No. 5,864,911 to Arnoux et al.

In the field of manual toothbrushes, however, the problem is not so readily solved. A wide variety of toothbrush structures have been proposed in an attempt to produce a secondary up-down motion even when the user only actively moves the toothbrush in a side-to-side primary direction of motion. Many of these employ rotatable bristle-carrying elements deployed so as to rotate about an axis perpendicular to the primary direction of motion. Examples of such structures may be found in U.S. Pat. No. 5,142,724 to Park, U.S. Pat. No. 5,186,627 to Amit et al., and U.S. Pat. No. 5,996,157 to Smith et al. None of these, however, has been found particularly effective.

An alternative solution is suggested in U.S. Pat. No. 1,643,217 to Lazarus. Here, a spiral arrangement of bristles extends along a rotatable shaft rotatably mounted parallel to the primary direction of motion. The description states that "the spiral arrangement of the bristle tufts tends to cause the bristle member, when rubbed against the teeth or the like to rotate on the handle and so to bring a fresh surface continually into use." In practice, however, since the axis of rotation is parallel to the direction of motion, it is clear that little or no rotation would actually be induced.

In an unrelated field of endeavor, U.S. Pat. No. 4,438,601 to Olson discloses a sandpaper cleaning device in which two rollers with brushes are set at an oblique angle to the handle. Because of the angle of the rollers, longitudinal motion of the device causes rotation of the rollers which, in turn, induces sideways "skidding" of the brushes across the sandpaper. A similar principle is used in various agricultural equipment. This concept has not, however, heretofore been used in the field of toothbrushes.

There is therefore a need for a manual toothbrush which would effectively produce a secondary up-down motion when the user only actively moves the toothbrush in a side-to-side primary direction of motion. It would also be highly advantageous to provide a method for brushing along a row of teeth so as to generate a brushing action perpendicular to a direction of motion.

SUMMARY OF THE INVENTION

The present invention is a toothbrush with longitudinal to lateral motion conversion. More specifically, the invention provides a non-powered toothbrush and a corresponding method for brushing teeth in which rotatable brush assemblies are moved along a row of teeth and generate a component of brushing motion perpendicular to the direction of motion. This perpendicular motion is generated by oblique alignment of a rotational axis of the brush assemblies and/or by mechanical interlocking of two rotatable brush assemblies with non-parallel axes.

Thus, according to the teachings of the present invention, there is provided, a method for brushing along a row of teeth so as to generate a brushing action perpendicular to a direction of motion, the method comprising: (a) providing a toothbrush including at least one rotatable brush assembly including a wheel configured to be rotatable about an axis, the wheel having a plurality of bristles diverging from the axis; (b) positioning the toothbrush with a number of the bristles in contact with a part of the row of teeth; and (c) moving the toothbrush along the row of teeth in a direction of motion, wherein the at least one rotatable brush assembly is oriented with its axis inclined at an angle of between about 15° and about 75° to the direction of motion such that rotation of the wheel caused by the movement generates a component of motion of the bristles contacting the row of teeth perpendicular to the direction of motion.

According to a further feature of the present invention, the at least one rotatable brush assembly is oriented with its axis inclined at an angle of between about 30° and about 60°, and more preferably, between about 40° and about 50°, to the direction of motion.

There is also provided according to the teachings of the present invention, a toothbrush for brushing teeth within a mouth of a user, the toothbrush comprising: (a) a handle; (b) a toothbrush head portion supported by the handle; and (c) a plurality of rotatable brush assemblies mechanically linked so as to move together with the handle, the rotatable brush assemblies being deployed so as to define a plane of contact with the teeth, each of the rotatable brush assemblies including a wheel configured to be rotatable about an axis, the wheel having a plurality of bristles diverging from the axis, wherein the axis of a first of the plurality of rotatable brush assemblies is non parallel to the axis of a second of the plurality of rotatable brush assemblies, and wherein the plurality of bristles of the first rotatable brush assembly interlock with the plurality of bristles of the second rotatable brush assembly such that, when the wheel of the first rotatable brush assembly is turned, the wheel of the second rotatable brush assembly also turns.

According to a further feature of the present invention, the axis of the first rotatable brush assembly is at between about 60° and about 120° to the axis of the second rotatable brush assembly.

According to a further feature of the present invention, the handle defines a primary direction of insertion, a projection of the axis of each of the rotatable brush assemblies onto the plane of contact being inclined relative to the primary direction of insertion by an angle of between about 15° and about 75°, more preferably between about 30° and about 60°, and most preferably between about 40° and about 50°.

According to a further feature of the present invention, the plurality of rotatable brush assemblies includes a first group for which the axis of rotation is parallel to the axis of the first rotatable brush assembly and a second group for which the axis of rotation is parallel to the axis of the second rotatable brush assembly.

According to a further feature of the present invention, each rotatable brush assembly from the first group has bristles interlocking with a corresponding rotatable brush assembly from the second group.

According to a further feature of the present invention, the axis of each of the rotatable brush assemblies is substantially parallel to the plane of contact.

According to a further feature of the present invention, the plurality of bristles of each rotatable brush assembly project substantially perpendicular to the axis.

BRIEF DESCRIPTION OF THE DRAWINGS

The invention is herein described, by way of example only, with reference to the accompanying drawings, wherein:

FIGS. 16A, 16B and 16C are, respectively, a side view, an isometric view and a plan view of the form of rotatable brush assembly used in the implementation of FIG. 15B.

DESCRIPTION OF THE PREFERRED EMBODIMENTS

The present invention is a toothbrush with longitudinal to lateral motion conversion.

The principles and operation of toothbrushes according to the present invention may be better understood with reference to the drawings and the accompanying description.

Figure 1B:
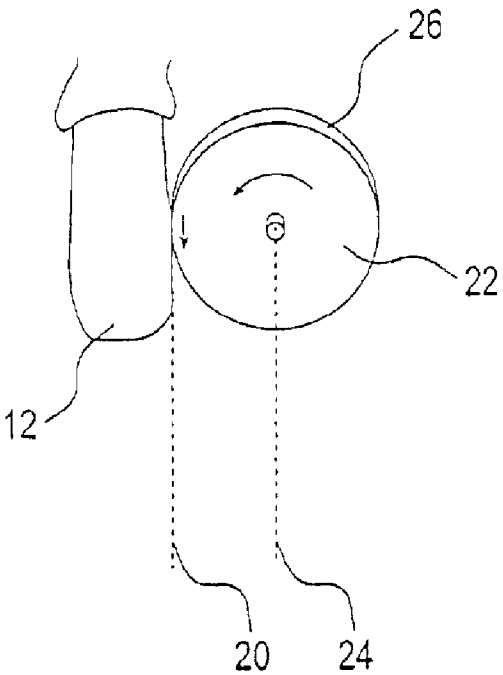
FIG. 1B is a second isometric view taken along the direction of motion of FIG. 1A.
Figure 1A:
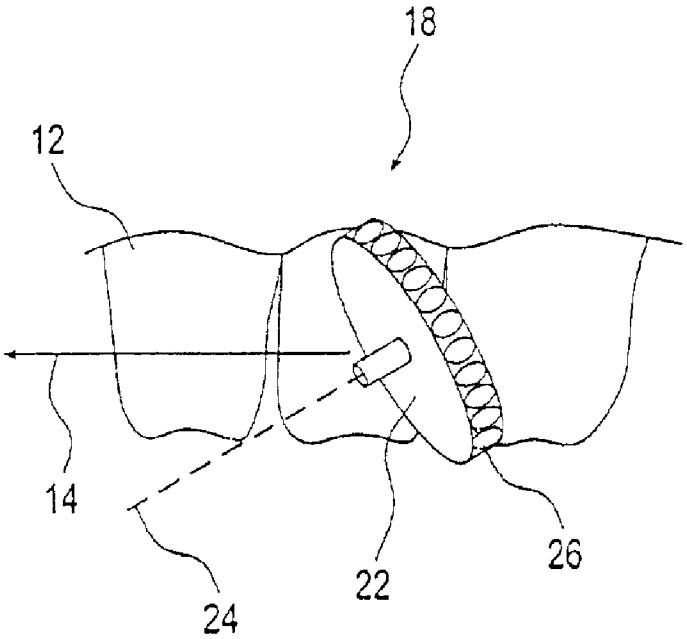
FIG. 1A is a first schematic isometric view of a rotatable brush assembly being moved in a direction of motion to brush teeth according to the principles of the present invention.
Figure 2:
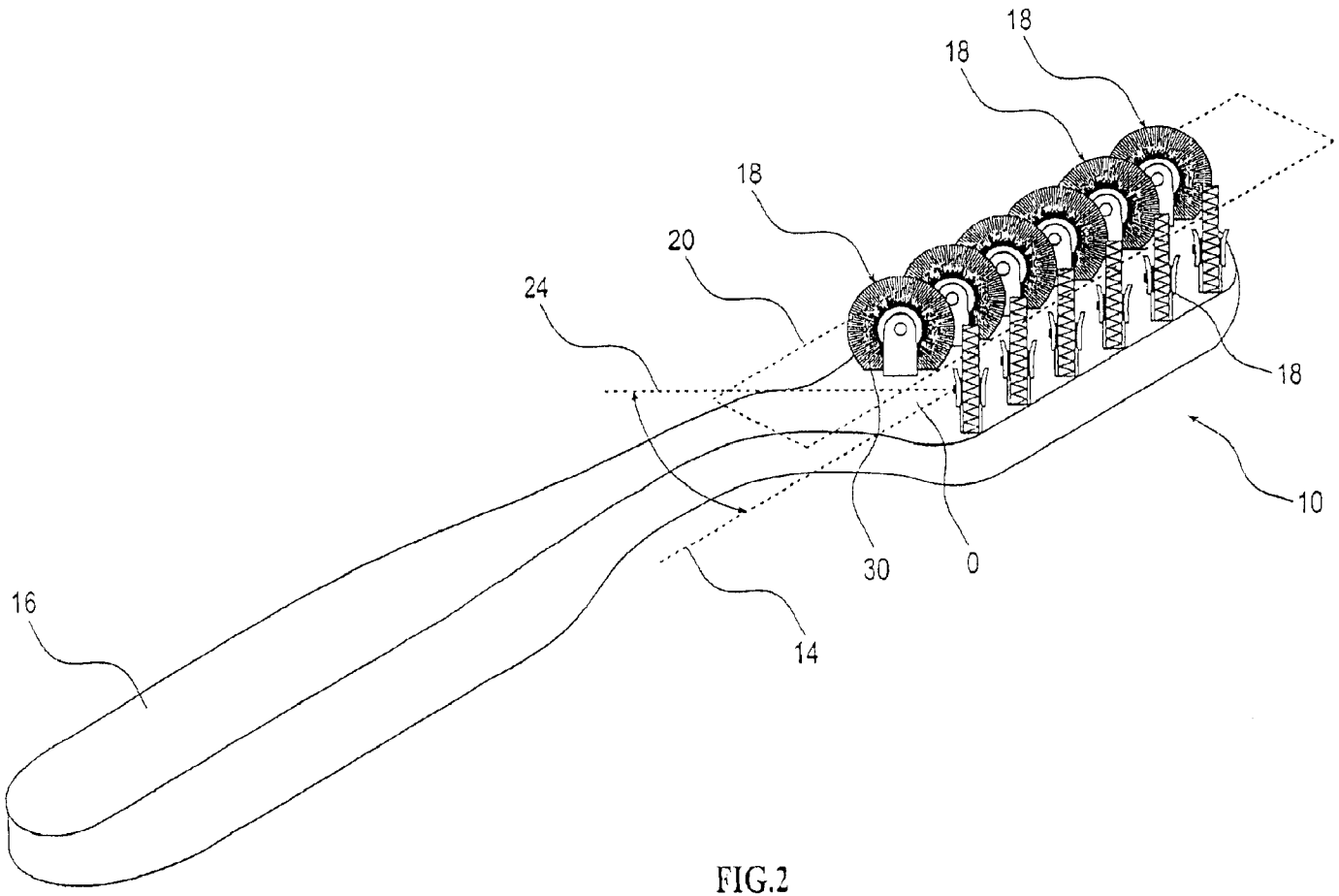
FIG. 2 is a schematic isometric view of a first embodiment of a toothbrush, constructed and operative according to the teachings of the present invention.

Referring now to the drawings, FIGS. 1A–5A illustrate a first embodiment of a toothbrush, generally designated 10, constructed and operative according to the teachings of the present invention, for brushing teeth 12 within a user's mouth. Toothbrush 10 is configured for use in a primary direction of motion 14 (FIG. 1A) which corresponds to a primary direction of insertion into the mouth as defined by the extensional direction of a toothbrush handle 16 (FIG. 2).

Generally speaking, toothbrush 10 includes a plurality of rotatable brush assemblies 18, mechanically linked so as to move together with handle 16, the rotatable brush assemblies being deployed so as to define a plane of contact 20 with the teeth. Each rotatable brush assembly 18 includes a wheel 22 configured to be rotatable about an axis 24, and having a plurality of bristles 26 diverging from axis 24 (typically projecting substantially radially therefrom). Each rotatable brush assembly 18 is configured such that its axis 24 lies substantially parallel to the plane of contact 20, or is inclined thereto by less than 70°. According to a first aspect of the present invention, it is particular preferred that a projection of axis 24 onto plane of contact 20 is inclined relative to primary direction of motion 14 by an angle θ of between about 15° and about 75°, more preferably between about 30° and about 60°, and most preferably between about 40° and about 50°. Typically, an angle of approximately 45° is most preferred.

As a result of this structure, when toothbrush 10 is inserted into the mouth, positioned with some of bristles 26 in contact with a part of the row of teeth 12 and moved in direction of motion 14, friction and/or mechanical engagement with the teeth causes rotation of rotatable brush assemblies 18. Due to the inclination of the axes 24 of rotatable brush assemblies 18 relative to the direction of motion 14, this rotation introduces a component of motion of the bristles 26 that are in contact with the teeth 12 in a direction perpendicular to direction of motion 14. As a result, the common side-to-side brushing action performed by most users inherently generates a significant secondary up-down brushing effect.

Before addressing the features of the present invention in more detail, it will be useful to define certain terms as used herein in the specification and claims. Firstly, when defining the geometrical features of the present invention, reference is made variously to the "primary direction of motion 14", the "primary direction of insertion into the mouth" and "the extensional direction of a toothbrush handle 16". In a typical case, these are all assumed to be parallel. Conceptually, it is the geometry with respect to the direction of motion which is essential to proper operation of the present invention. The extensional direction of the handle is chosen as a structural feature which is related to the direction of motion. However, it will be noted that toothbrush handles are often designed to be non-parallel to the head of the toothbrush. For this reason, reference is made to a "primary direction of insertion of the toothbrush into the mouth" defined by the handle configuration. This direction is defined as the projection of the extensional direction of the handle onto plane 20. This geometrical construct corresponds to the direction of motion which will be performed by a typical user performing a side-to-side type brushing action.

Axis 24 is non-perpendicular to the plane of contact, and is most preferably substantially parallel to plane of contact 20. This is in clear contrast to the numerous conventional structures where a bristle-supporting element is rotatable about an axis substantially perpendicular to the plane of contact. Such structures are clearly incapable of functioning according to the principles of the present invention. It should be noted that "substantially parallel" in this context should be interpreted broadly to encompass a considerable range of angles (up to as much as ±30°) between axis 24 and plane 20 within which the principles of the present invention are still operative. In order to precisely define angle θ for cases where the axis is non-parallel to the plane of contact, the aforementioned angle θ may be defined independent of the angle of elevation of the axis relative to the plane of contact as follows: θ is defined as the angle between the primary direction of motion and the projection of axis 24 onto plane 20. So long as angle θ thus defined falls within the stated range of between about 15° and about 75°, the longitudinal to lateral motion conversion effect is still achieved. Clearly, when axis 24 is parallel to plane 20, the projection of the axis onto the plane is the same as the axis itself.

Figure 11:
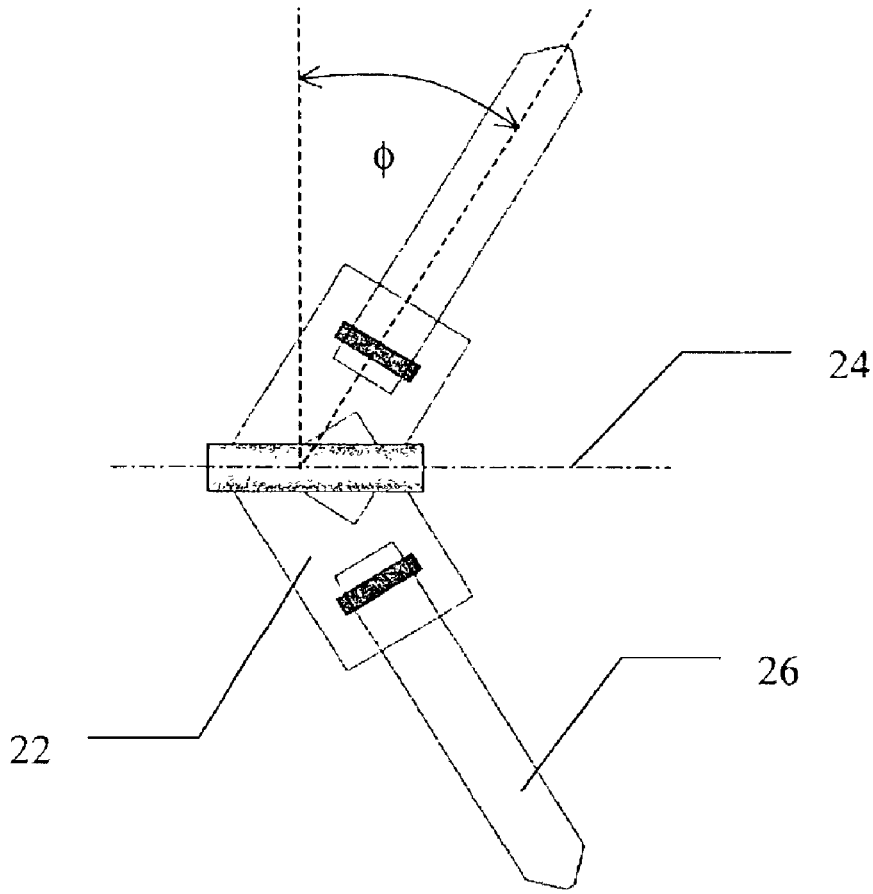
FIG. 11 is a schematic cross-sectional view through a further alternative implementation of a bristle wheel assembly for use in a toothbrush constructed and operative according to the teachings of the present invention.

By way of a specific example, reference is made briefly to FIG. 11 which shows a bristle wheel assembly with an external conical angle ϕ of up to about 70°, and preferably no more than about 30°. In this case, the wheels are preferable mounted with axis 24 inclined at a corresponding angle to the plane of contact so that the bristles in contact with the teeth stand roughly perpendicular to the surface brushed. This conical wheel structure has a reduced diameter as compared to a flat wheel with similar length bristles, thereby offering reduced toothbrush head size. The conical angle thus defined, and the corresponding elevation angle of axis 24 out of the plane of contact may in fact be increased well beyond 30°, so long as the angle does not exceed about 70° and the required range of angle θ as defined above is maintained. Nevertheless, conical angles no greater than 30° are believed to be preferable. In cases where multiple rotating brush assemblies with differing values of θ are used, the angle of elevation of axis 24 from the plane of contact is preferable the same for all rotatable brush assemblies.

With regard to the tern "bristles", this is used herein generically to refer to any and all fibers suited for use in toothbrushes, including natural and synthetic bristles.

Figures 3A, 3B:
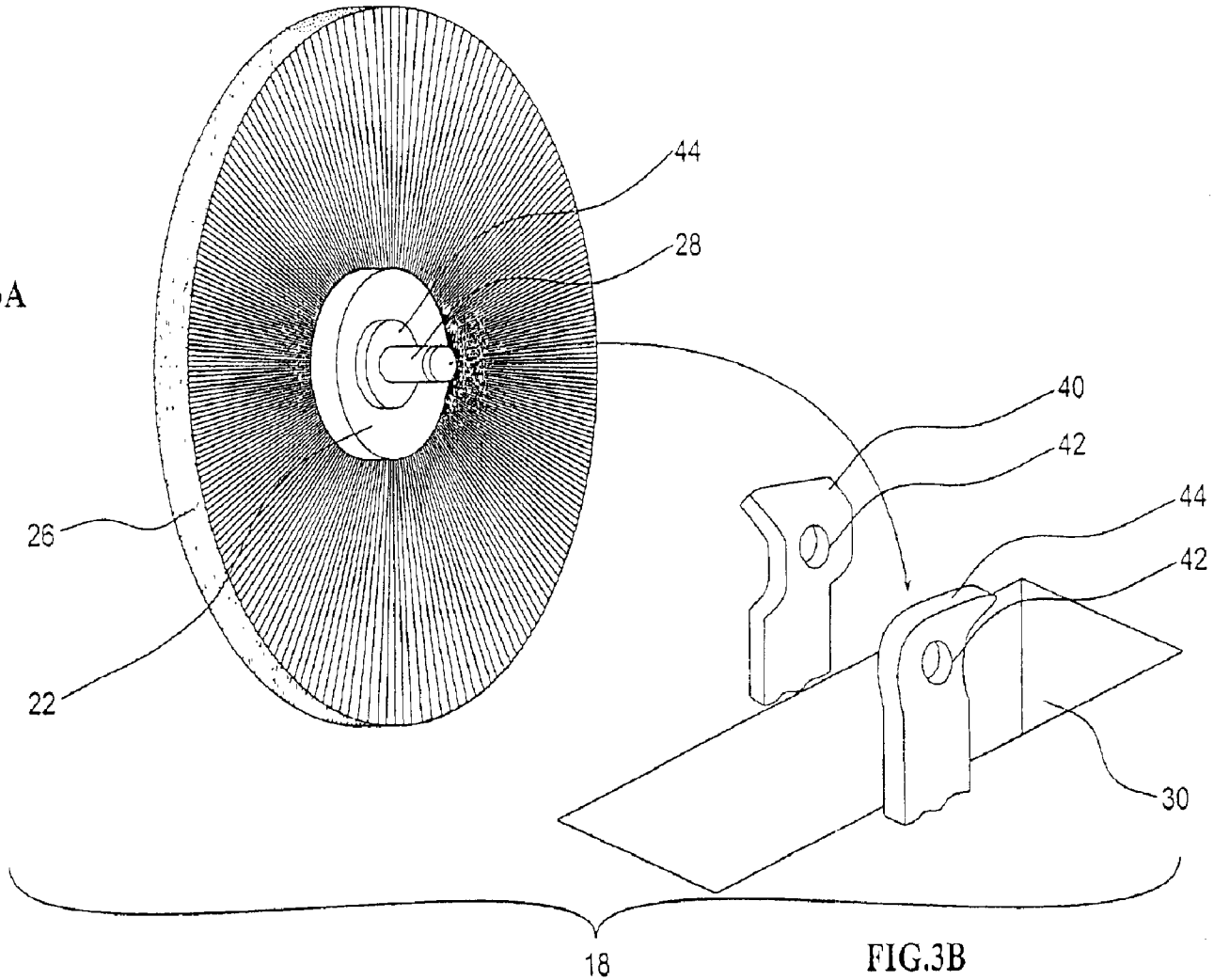
FIGS. 3A and 3B are schematic isometric views of a wheel assembly and a socket, respectfully, together forming a preferred implementation of a rotatable brush assembly of the toothbrush of FIG. 2.
Figure 4:
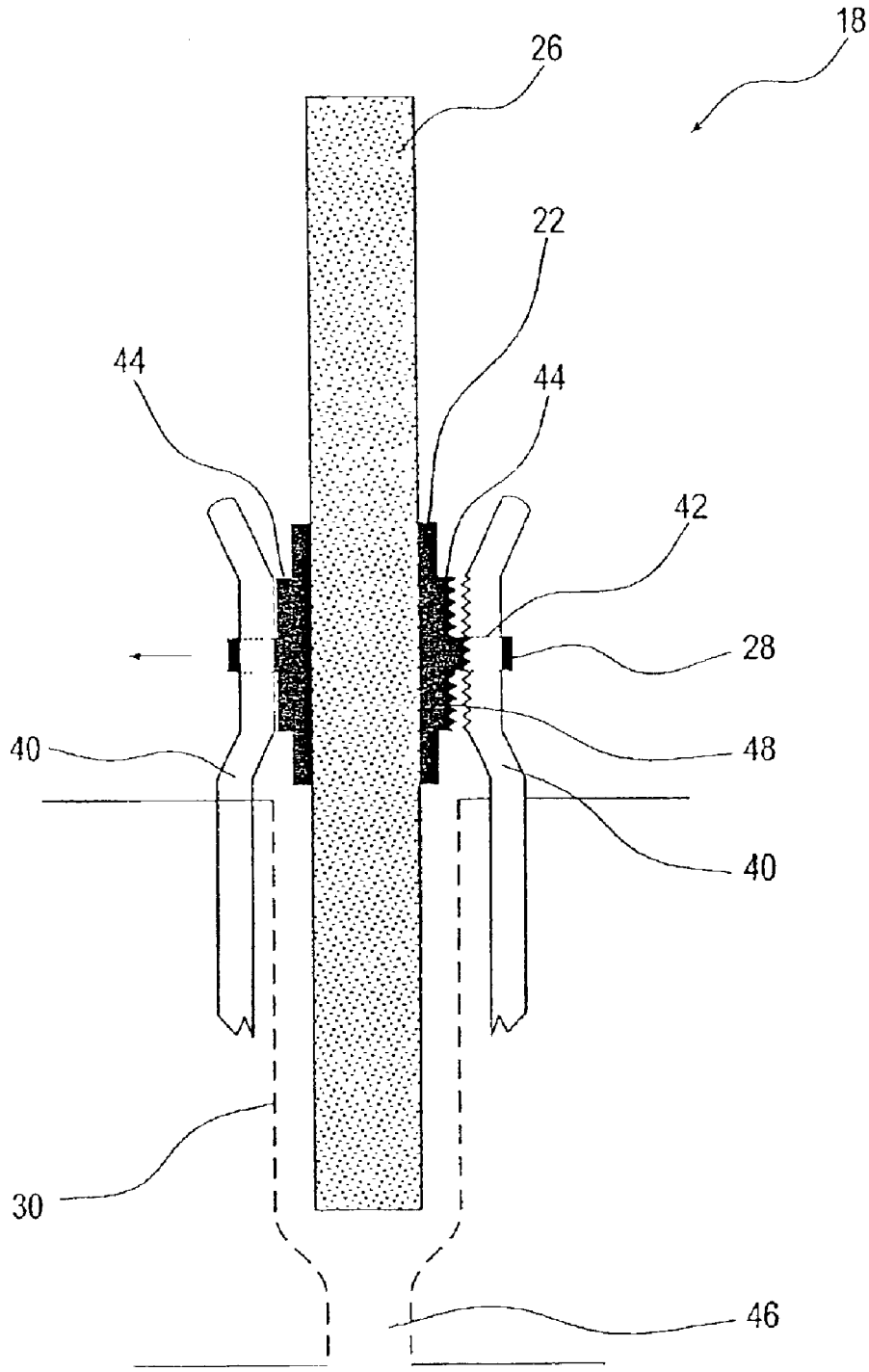
FIG. 4 is a schematic cross-sectional view taken through the rotatable brush assembly of the toothbrush of FIG. 2.

Turning now to the features of toothbrush 10 in more detail, FIGS. 3A, 3B and 4 illustrate a first preferred implementation of a rotatable brush assembly 18 for use in the present invention. This form is particularly preferred for its simplicity of production and assembly.

FIG. 3A shows wheel 22 with radially projecting bristles 26 prior to assembly. In this case, wheel 22 is formed with axial projections 28 to serve as an axle. This structure can be produced by a range of known manufacturing techniques used in the field. Examples include, but are not limited to, implantation of fiber bundles into softened plastic and injection molding around a prepared arrangement of fibers.

FIG. 3B shows the preferred form of a corresponding socket 30 formed in the surface of the head portion of toothbrush 10. Within, or adjacent to, socket 30 stand two spring brackets 40 which have recesses 42 configured to provide a permanent snap-fit engagement with projections 28 to define the axis of rotation of wheel 22 when assembled. The remainder of socket 30 is shaped to accommodate at least a proportion of bristles 26 in a manner to allow unimpeded rotation thereof of wheel 22. Optionally, wheel 22 may be formed with a slightly projecting hub 44 surrounding projection 28 so as to provide a well defined reduced-area contact surface with brackets 40, thereby reducing frictional opposition to rotation of the wheel.

It will be appreciated that the entire body of toothbrush 10, including the head of the toothbrush formed with sockets 30 and the toothbrush handle, may conveniently be produced as a single integral element by a range of well known techniques such as plastic injection molding around suitable metallic brackets. Preferably, as may be seen in FIG. 4, each socket 30 is additionally formed with a drainage channel 46 open to the rear of the toothbrush head to facilitate flushing out and cleaning of the assembly.

Figure 5A:
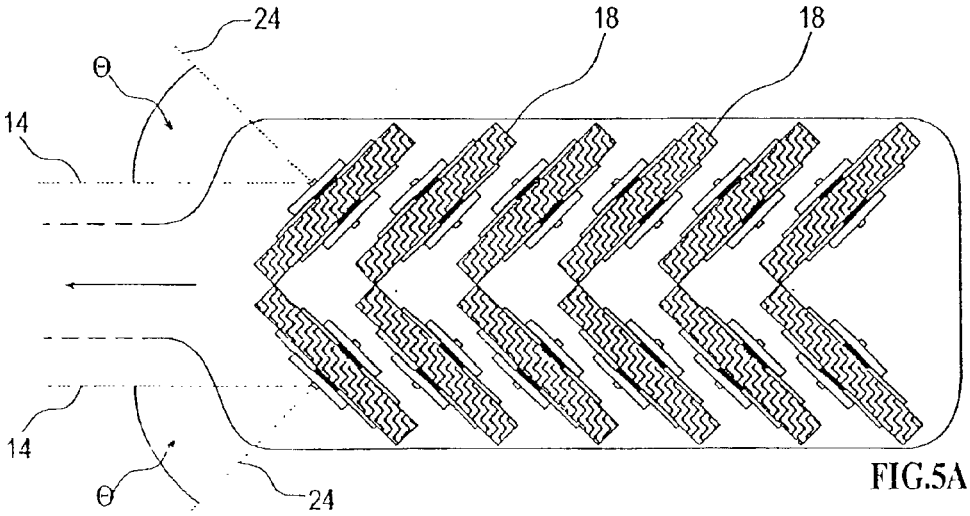
FIG. 5A is a plan view of the toothbrush of FIG. 2.
Figure 5B:
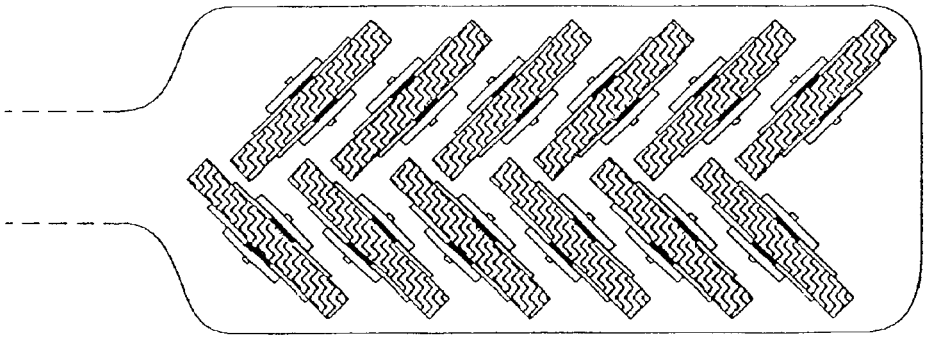
FIG. 5B is a plan view of a first variant of the toothbrush of FIG. 2, employing a staggered pattern of rotatable brush assemblies.
Figure 5C:
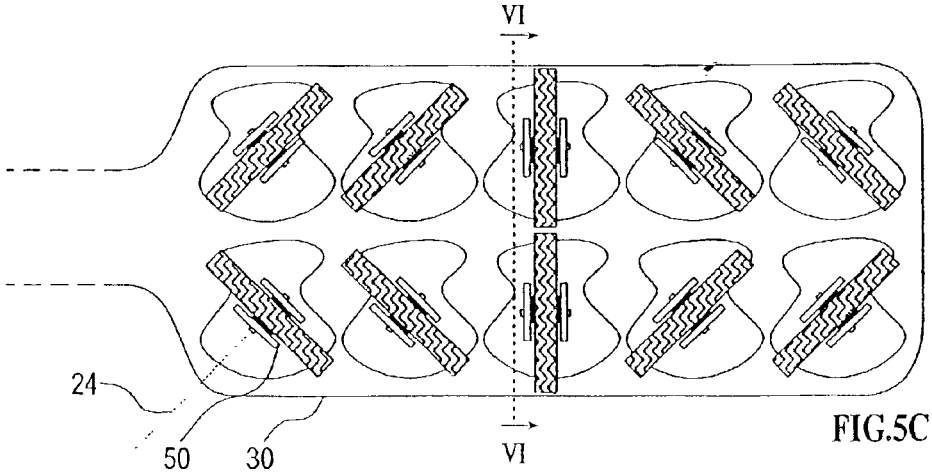
FIG. 5C is a plan view of a second variant of the toothbrush of FIG. 2, employing variable angle rotatable brush assemblies.

It will be noted that a single rotatable brush assembly 18 of the structure described herein would have a tendency to creep laterally from the intended direction of motion. To counteract this tendency, toothbrush 10 preferably includes at least two groups of rotatable brush assemblies 18 inclined in opposite senses relative to the primary direction of insertion. By way of a preferred example, FIGS. 2, 5A and 5B show embodiments with two groups of rotatable brush assemblies 18 arrayed along two parallel lines with angles of inclination ±θ, respectively, relative to the primary direction of insertion. In this case, the arrays of rotatable brush assemblies 18 extend parallel to the direction of insertion. The implementations of FIGS. 2 and 5A differ only in that the sense of inclination of the two rows has been reversed.

Although the rotatable brush assemblies 18 are preferably deployed in groups inclined in opposing senses for the reasons already mentioned, details of the deployment may clearly be varied considerably. Thus, depending upon the size of the elements, more than two rows may be provided. Optionally, the rows may be staggered, such as is shown in FIG. 5B, to achieve effective close packing of the rotatable brush assemblies 18.

Figure 17:
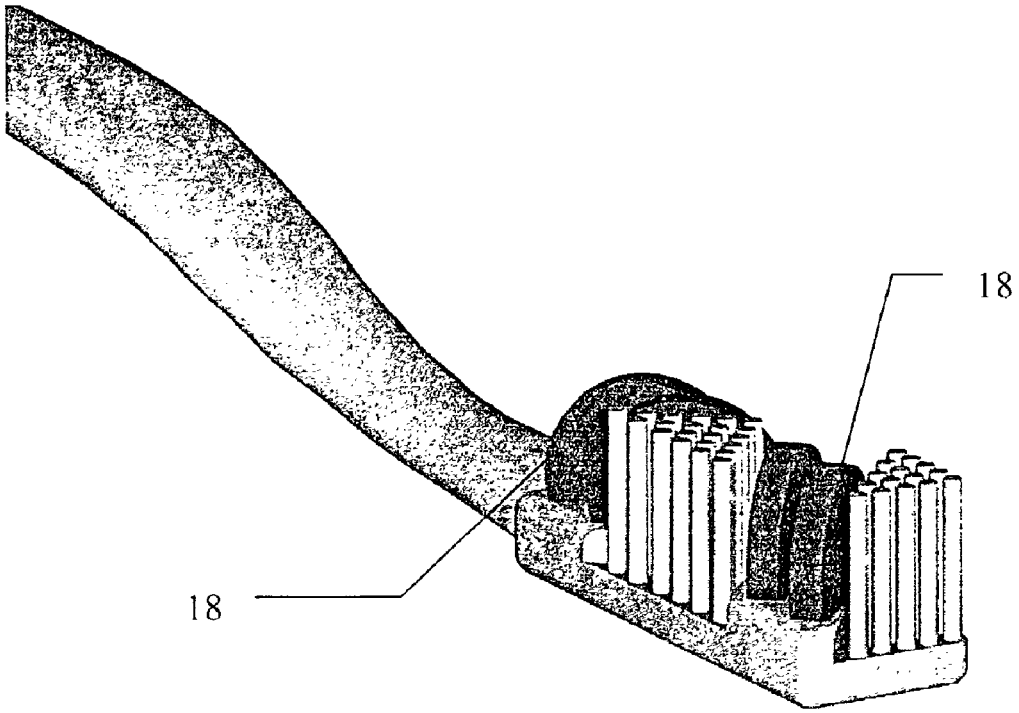
FIG. 17 is an isometric view of an implementation of a toothbrush in which rotatable brush assemblies are combined with regions of fixed bristles.

A further option for implementation is illustrated in FIG. 17. Here, one or more rotatable brush assembly is arrayed along the primary direction of insertion. This example also illustrates a further preferred option in which the toothbrush also provides a plurality of fixed bristles to complement the action of the rotatable brush assemblies. In this implementation where the rotatable assemblies are set at inclinations of ±θ, the geometry inherently provides triangular regions between the assemblies which may be used to support fixed bristles as shown.

In a first set of implementations of the present invention, rotatable brush assemblies 18 turns freely in both directions. As a result, in the configurations shown in FIGS. 5A and 5B, rotation of the assemblies causes an inwards brushing action, towards the center of the toothbrush head, when the toothbrush is advanced forward within the mouth, and an outward brushing action as it is withdrawn. Although this alternating direction is believed to be acceptable in many application, it is believed that superior results may sometimes be provided by modifying the assemblies to rotate exclusively in one direction, providing a ratchet-type functionality. This feature is preferably used to configure the rotatable assemblies to brush exclusively inwards, so that they do not turn during alternate strokes of the toothbrush. One preferred implementation of this optional feature is illustrated in FIG. 4.

Specifically, wheel 22 is shown here to have an axial dimension between hubs 44 slightly smaller than the spacing between brackets 40 so that it only one hub is in contact with its adjacent bracket at any time. One of hubs 44 is made smooth, while the other is enlarged and/or modified by addition of radial ribs 48 or other surface features configured to provide increased friction. The region of one bracket 40 opposite to the increased friction surface is preferably also roughened in a complementary manner.

This structure provides a very simple and reliable, but yet effective, ratchet-type function. Specifically, when the toothbrush is advanced in a first direction, the forces on wheel 22 move it axially to a first position in which the smooth hub 44 contacts the corresponding bracket 40, thereby allowing wheel 22 to turn freely during operation as described above. When the direction of toothbrush motion is reversed, wheel 22 moves axially to contact the second bracket. In this position, the increased friction surfaces of the second hub and corresponding bracket are brought into contact, generating sufficient frictional resistance to substantially prevent rotation of wheel 22 during the reverse toothbrush stroke.

According to a further optional feature, the rotating brush assemblies may be configured to operate during both stroke directions of the toothbrush exclusively inwards (or outwards) with respect to the toothbrush head. This may be achieved by use of a swivel-mounted rotatable brush assembly, as will now be described with reference to FIGS. 5C and 6.

Specifically, in this example, each assembly 18 is configured to swivel about a swivel axis 50 substantially perpendicular to contact plane 20 so that its axis of rotation 24 can vary over a range of $\pm\theta$ relative to direction of motion 14. Swivel axis 50 is preferably offset relative to the axis 24 of wheel 22 so that forces acting on wheel 22 from friction of bristles 26 with the teeth generate a turning moment about swivel axis 50 tending to swivel the assembly to the desired angle.

Figure 6:
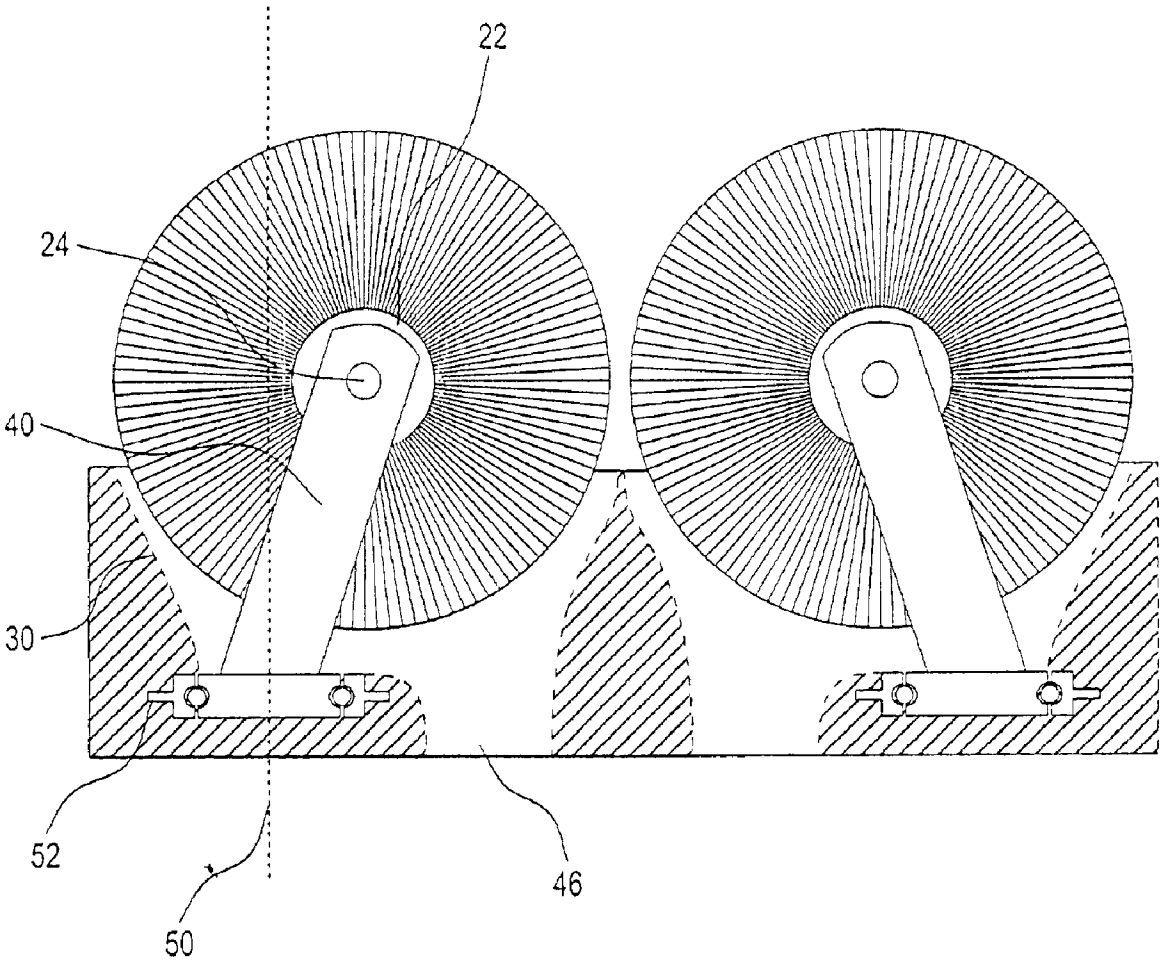
FIG. 6 is a schematic cross-sectional view taken along line VI—VI of FIG. 5C illustrating a preferred structure for the variable angle rotatable brush assembly.

Structurally, details of a preferred implementation are shown in FIG. 6. Swivel axis 50 is here provided by a rotary sliding bearing 52 which is implanted within the base of an enlarges socket 30. Brackets 40 here extend upwards at an angle to provide the aforementioned offset between swivel axis 50 and the axis 24 of wheel 22.

Turning now to FIGS. 7–10, it should be noted that the rotatable brush assembly 18 of FIGS. 3 and 4 is one preferred example chosen from a large number of possible implementations. By way of illustration, FIGS. 7–10 show a number of alternative implementations.

Figures 7A, 7B:
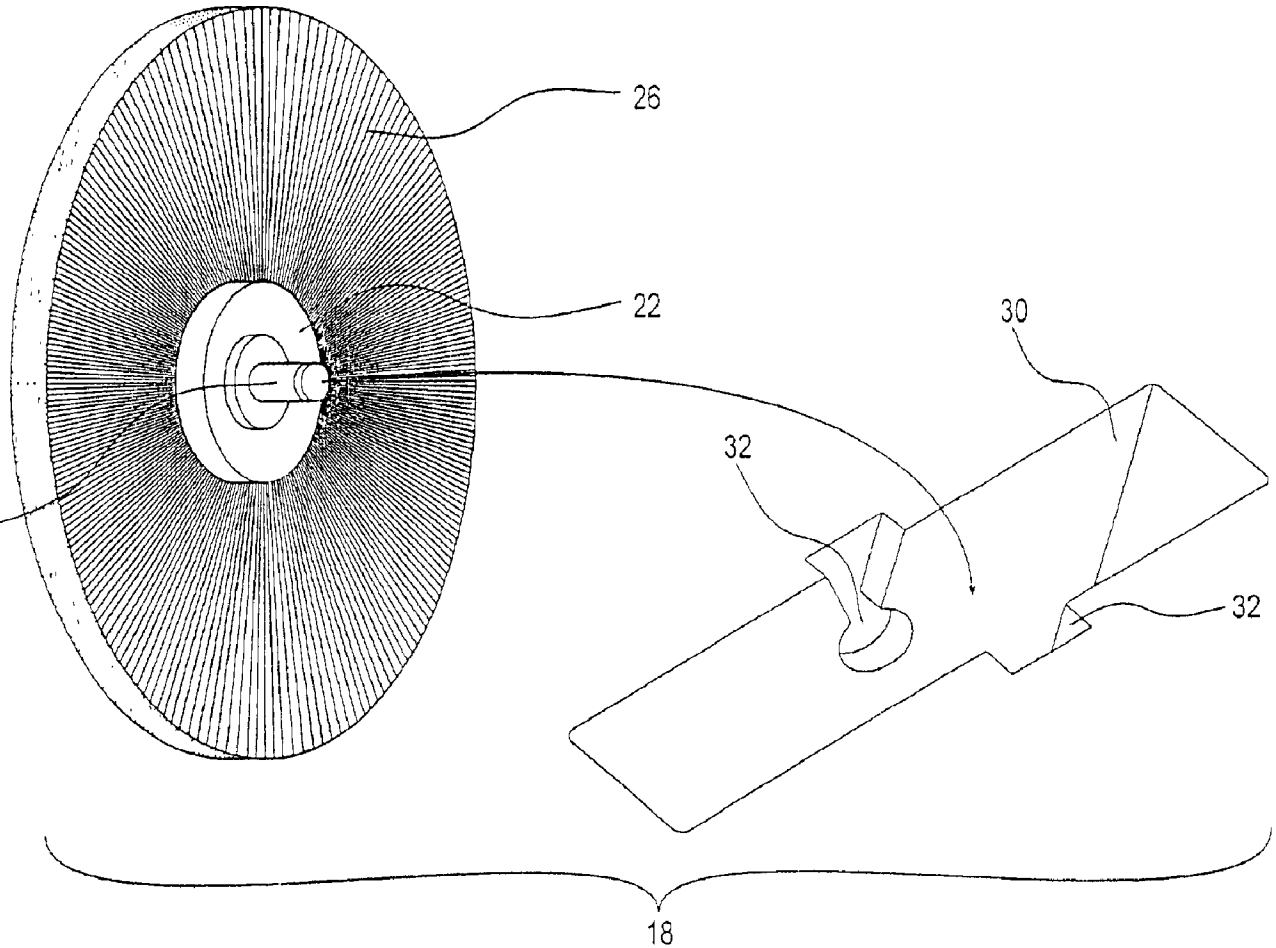
FIGS. 7A and 7B are schematic isometric views of a wheel assembly and a socket, respectfully, together forming a first alternative construction of a rotatable brush assembly of the toothbrush of FIG. 2.

Referring to FIGS. 7A and 7B, these show a structure generally similar to that of FIGS. 3 and 4, but wherein socket 30 features two shaped recesses 32 integrally formed on opposite sides of the socket to provide a snap-fit engagement with projections 28. In this case, just over half of each wheel 22 is housed within the head of the toothbrush when assembled. Optionally, socket 30 may have an increased width portion around its periphery, i.e., remote from recesses 32, to allow free rotation of the wheel even if bristles 26 become bent apart as a result of extensive use.

Figure 8:
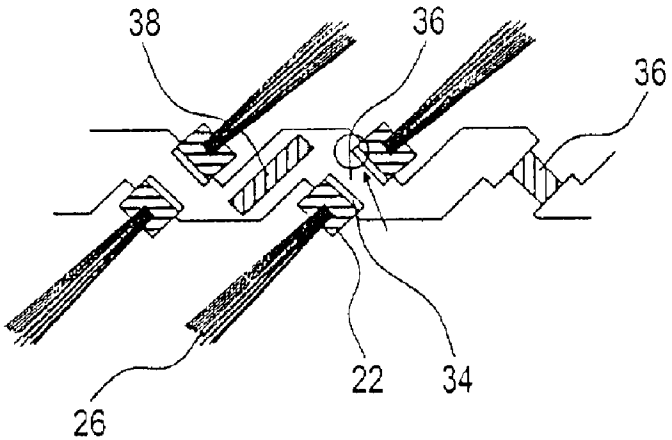
FIG. 8 is a schematic cross-sectional view showing a suspended rotatable brush assembly for use in a toothbrush constructed and operative according to the teachings of the present invention.

Turning now to FIG. 8 this shows an alternative implementation of rotatable brush assemblies 18 in which wheels 22 have hollow axial recesses or bores 34 which receive axle elements 36 which are supported above a surface of the toothbrush head by support posts 38. The result is a series of wheels rotatably mounted on a zigzag frame standing above the surface of the toothbrush head. Axle elements 36 may either be complete rods, or may be implemented as pairs of opposing projections which snap-fit into recesses or bores 34 on opposite sides of each wheel 22.

Figure 9:
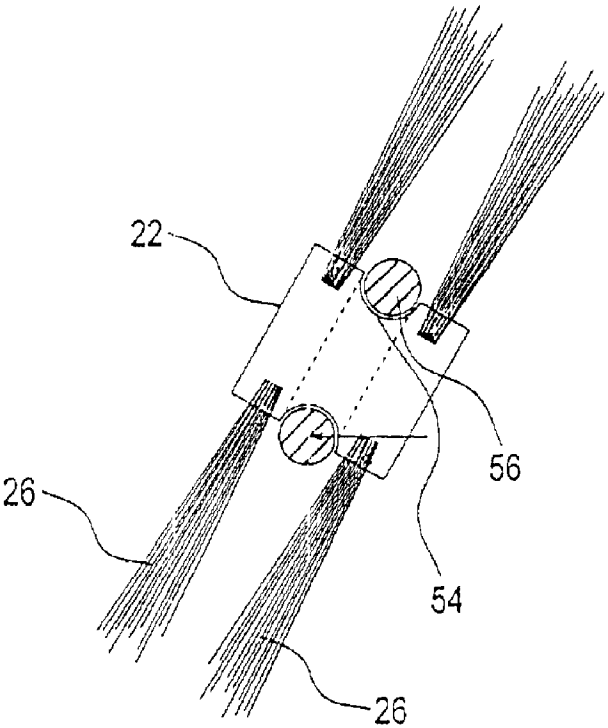
FIG. 9 is a schematic cross-sectional view of an alternative suspended rotatable brush assembly for use in a toothbrush constructed and operative according to the teachings of the present invention.

FIG. 9 shows a further alternative implementation in which each wheel 22 is formed from two parts which lock together to form a double wheel structure with a peripheral annular groove 54 which cooperates with a complementary slip ring 56. In this case, the two parts of wheel 22 are preferably snap-fitted or otherwise attached to each other during assembly of the toothbrush in position engaged with slip ring 56 as shown.

Figure 10:
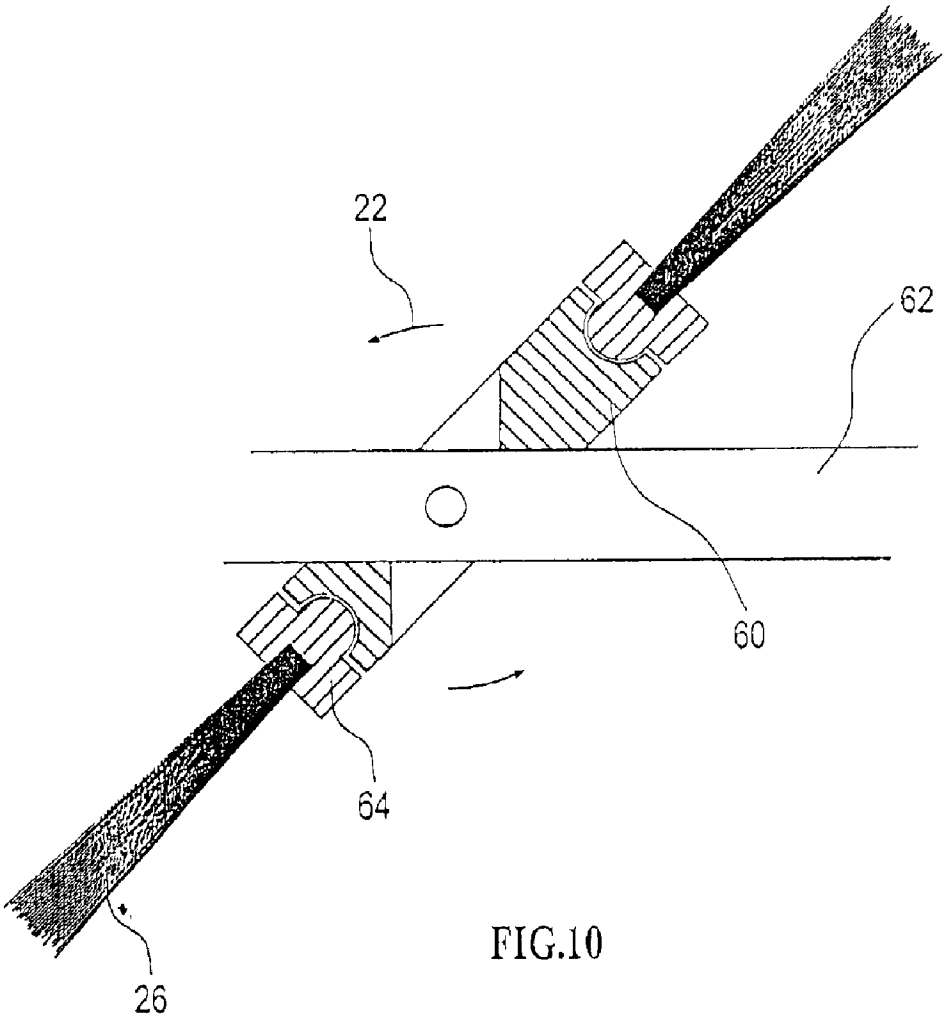
FIG. 10 is a schematic cross-sectional view showing a suspended rotatable brush assembly configured for implementing the mode of operation of FIG. 5C.

Parenthetically, with reference to FIG. 10, it should be noted that the aforementioned swivel-mounted rotatable brush assembly may also be implemented in alternative forms. By way of example, FIG. 10 shows a possible implementation in which a central, non-turning hub 60 of wheel 22 is mounted on a support bar 62 to provide a swivel joint offset from the center of central hub 60. The rotating portion of wheel 22 is implemented as an outer ring 64 deployed externally in sliding relation to central hub 60.

Turning finally to FIGS. 12–15, there is illustrated a further preferred feature of the present invention, namely, intermeshing or interlocking of bristles between different rotatable brush assemblies.

Figure 12:
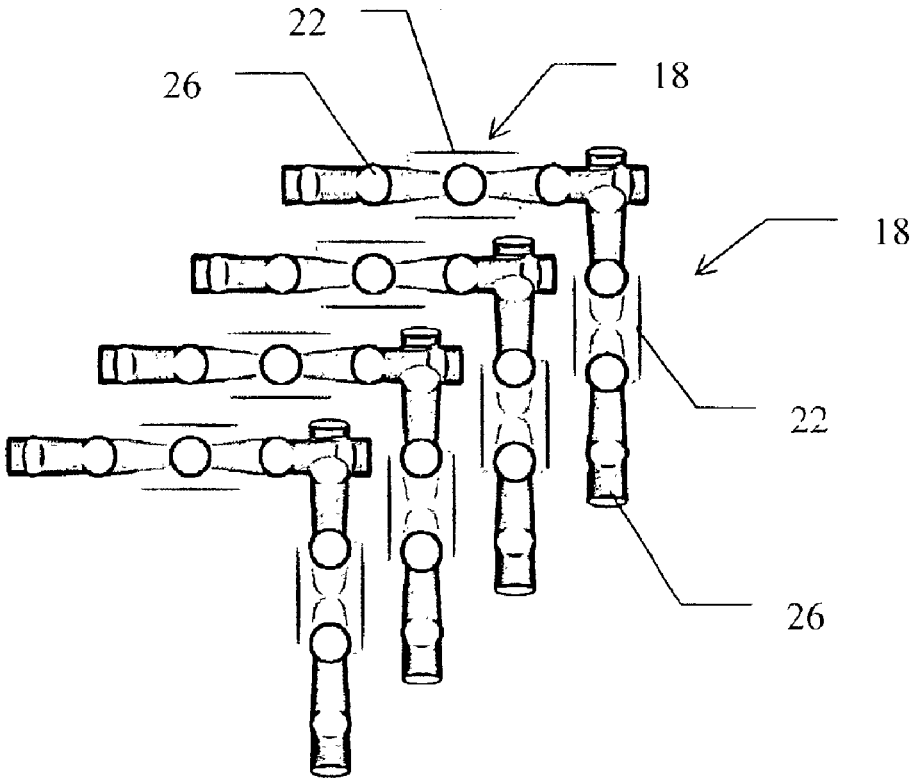
FIG. 12 is a plan view of a further alternative layout of rotatable brush assemblies according to the present invention providing an interlocked bristle structure.
Figure 13:
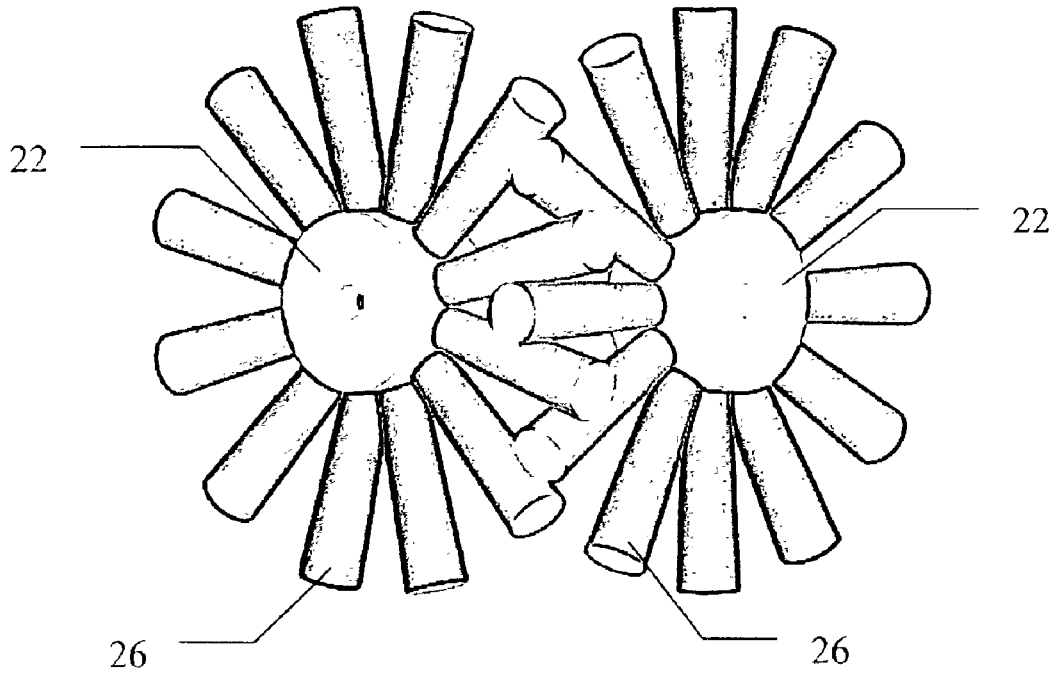
FIG. 13 is an isometric view of a pair of bristle wheels from the implementation of FIG. 12 illustrating the interlocking of the bristles.

Specifically, FIG. 12 is a schematic representation of a preferred layout of the present invention with two rows of rotatable brush assemblies 18. In this case, the rows are deployed sufficiently close together that pairs of the rotatable brush assemblies from adjacent rows have their bristles 26 interlocking. This provides a mechanical linkage between the wheels 22 of the rotatable brush assemblies so that when one rotates it causes the other to rotate simultaneously.

It will be appreciated that this feature provides a major advantage during operation of the toothbrush of the present invention. While the previously described embodiments are highly effective when used properly, they are sensitive to misalignment relative to the direction of motion. If the toothbrush is held at an angle so that the axis of the rotatable brush assembly is parallel to the direction of motion, the motion will fail to generate rotation of the wheel, whereas if it is held so that the axis is perpendicular to the direction of motion, the wheel will turn without generating a significant transverse component of brushing. The present embodiment addresses this problem by ensuring that both wheels of each pair will turn even if one is at an angle which would not otherwise generate rotation. As a result, by using pairs of wheels with non-parallel axes, it is possible to ensure that movement in substantially any direction will generate a significant component of brushing motion perpendicular to the direction of motion.

As already mention, the mechanical linkage between the wheels of the rotatable brush assemblies is achieved by interlocking of the bristles 26. This provides a particularly simple, reliable and cost effective structure, avoiding the need for complicated high precision arrangements of gear wheels or the like. According to a first preferred implementation as illustrated here, the bristles of each wheel are implemented as groups or "tufts" of close packed bristles arranged radially so that, at their extremities, there are spaces between them. In this case, the wheel typically interlocks in a manner similar to a sprocket wheel. Alternatively, a less orderly intermeshing of bristles distributed around the periphery of each wheel may be used.

As mentioned above, the axes of pairs of wheels with interlocked bristles are non-parallel. In order to ensure significant transverse components of the brushing motion under a wide range of operational conditions, the angle between the two axes is preferably between about 60° and about 120°, an most preferably within ±10° of 90°.

As mentioned above, this implementation is operative without any additional power supply to convert part of a movement in a first direction into a brushing action with a non-zero component in a direction perpendicular to the first direction when used at a wide range of different angles. Thus, for example, it is possible to implement an embodiment of the invention (not shown) in which the axes of the rotatable brush assemblies are parallel and perpendicular to the direction of insertion. In this case, the wheels with axes perpendicular to the motion are effectively drive wheels for the wheels with axes parallel to the motion while the latter provide an effective transverse brushing action. More preferably, each rotatable brush assembly is deployed at an angle to the primary direction of motion (or handle extensional direction) as defined in the previous implementations, thereby optimizing the performance of each brush assembly individually.

Figure 14:
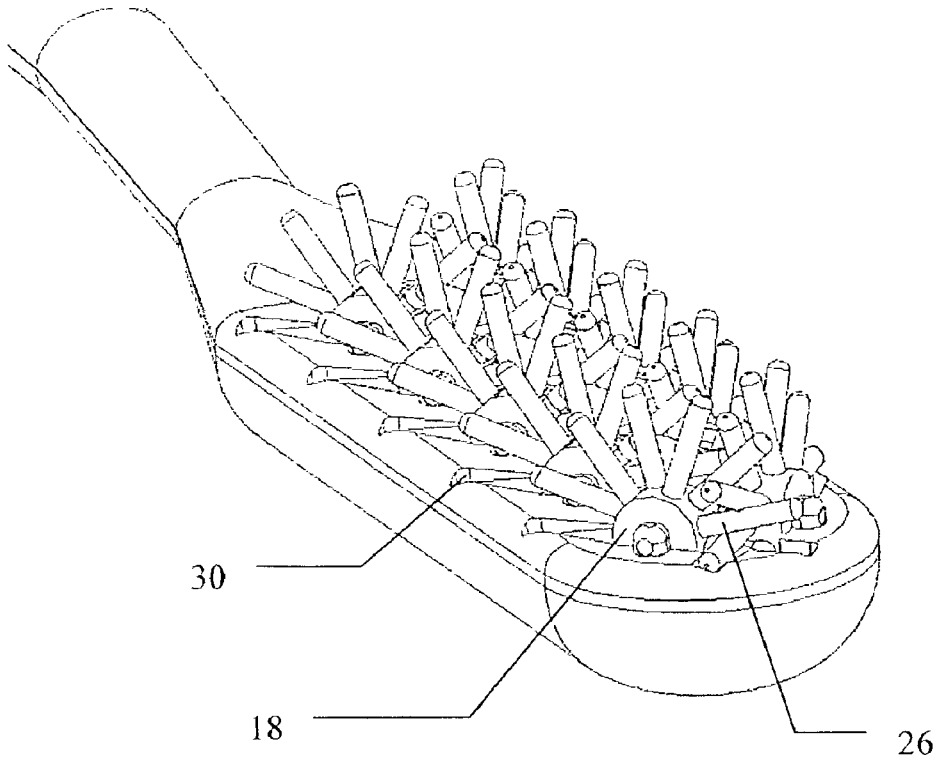
FIG. 14 is an isometric view of a toothbrush head, constructed and operative according to the teachings of the present invention, employing the rotatable brush assembly layout of FIG. 12.
Figure 15A:
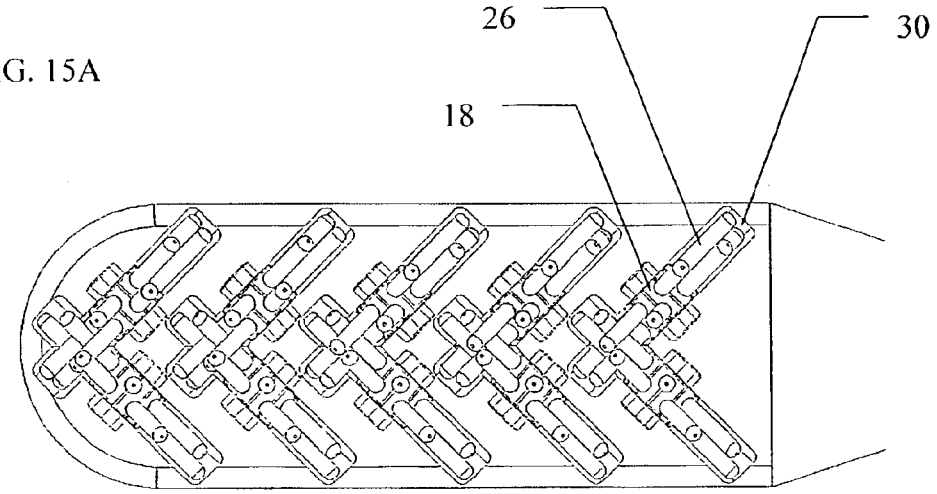
FIG. 15A is a plan view of the toothbrush head of FIG. 14 implemented using a first preferred form of rotatable brush assembly with staggered rows of bristles.
Figure 15B:
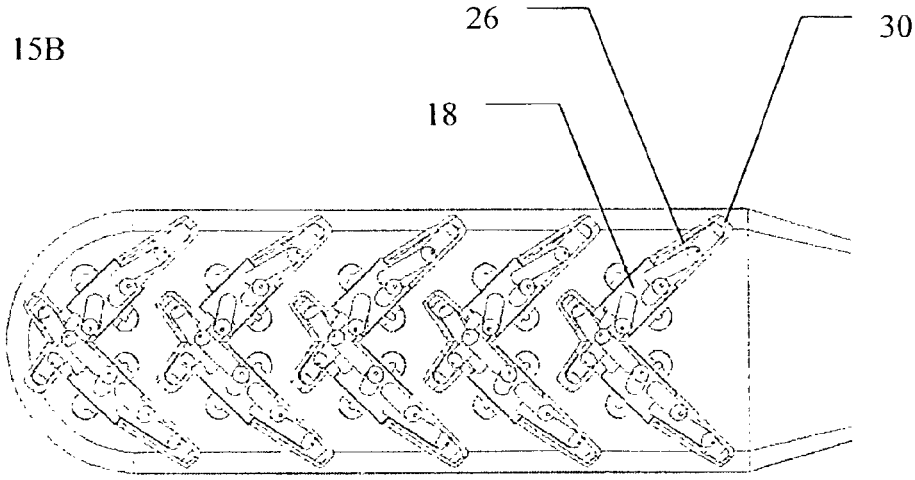
FIG. 15B is a plan view of the toothbrush head of FIG. 14 implemented using a second preferred form of rotatable brush assembly with staggered rows of bristles.

FIGS. 14–15B show the head of a toothbrush employing the aforementioned interlocking bristle layout. In order to achieve an increased density of bristles 26 around the periphery of wheel 22, certain implementations of the present invention employ two or more rows of bristles in staggered positions around the central hub of wheel 22. FIG. 15A shows such an implementation wherein the bristles are all directed radially outwards from the axis 24. In an alternative preferred implementation, one or more of the rows of bristles 26 are inclined relative to the radial direction so that the bristle tufts converge towards a common peripheral circle. A wheel 22 of this type is illustrated in more detail in FIGS. 16A–16C. As seen in FIG. 15B, this structure allows the use of sockets 30 with narrower extremities, thereby allowing a reduction of the dimensions of the toothbrush head relative to that of FIG. 15A. This structure also achieves a higher bristle density at the outer extremity of the wheel than could otherwise be achieved with a compact central wheel hub. This bristle wheel structure is believed to be of particular significance for use in this and other toothbrush devices where a rotatable bristle-carrying wheel is required.

It will be appreciated that the above descriptions are intended only to serve as examples, and that many other embodiments are possible within the scope of the present invention as defined in the appended claims.

What is claimed is:

1. A toothbrush for brushing teeth within a mouth of a user, the toothbrush comprising:

(a) a handle;

(b) a toothbrush head portion supported by said handle; and (c) a plurality of rotatable brush assemblies mechanically linked so as to move together with said handle, said rotatable brush assemblies being deployed so as to define a plane of contact with the teeth, each of said rotatable brush assemblies including a rotary element configured to be rotatable about an axis, said rotary element having a plurality of bristles diverging from said axis, wherein said axis of a first of said plurality of rotatable brush assemblies is non parallel to said axis of a second of said plurality of rotatable brush assemblies, and wherein said plurality of bristles of said first rotatable brush assembly interlock with said plurality of bristles of said second rotatable brush assembly such that, when said rotary element of said first rotatable brush assembly is turned, said rotary element of said second rotatable brush assembly also turns.

2. The toothbrush of claim 1, wherein said axis of said first rotatable brush assembly is at between about 60° and about 120° to said axis of said second rotatable brush assembly.

3. The toothbrush of claim 1, wherein said handle defines a primary direction of insertion, a projection of said axis of each of said rotatable brush assemblies onto said plane of contact being inclined relative to said primary direction of insertion by an angle of between about 15° and about 75°.

4. The toothbrush of claim 1, wherein said handle defines a primary direction of insertion, a projection of said axis of each of said rotatable brush assemblies onto said plane of contact being inclined relative to said primary direction of insertion by an angle of between about 30° and about 60°.

5. The toothbrush of claim 1, wherein said handle defines a primary direction of insertion, a projection of said axis of each of said rotatable brush assemblies onto said plane of contact being inclined relative to said primary direction of insertion by an angle of between about 40° and about 50°.

6. The toothbrush of claim 1, wherein said plurality of rotatable brush assemblies includes a first group for which the axis of rotation is parallel to said axis of said first rotatable brush assembly and a second group for which the axis of rotation is parallel to said axis of said second rotatable brush assembly.

7. The toothbrush of claim 6, wherein each rotatable brush assembly from said first group has bristles interlocking with a corresponding rotatable brush assembly from said second group.

8. The toothbrush of claim 1, wherein said axis of each of said rotatable brush assemblies is substantially parallel to said plane of contact.

9. The toothbrush of claim 1, wherein said plurality of bristles of each rotatable brush assembly project substantially perpendicular to said axis.

* * * * *